US010647392B2

(12) United States Patent
Trewern

(10) Patent No.: US 10,647,392 B2
(45) Date of Patent: May 12, 2020

(54) MODULE FOR CONNECTING A MAST TO A BOARD

(71) Applicant: Fliteboard Pty Ltd, New South Wales (AU)

(72) Inventor: David Trewern, New South Wales (AU)

(73) Assignee: FLITEBOARD PTY LTD (AU)

( * ) Notice: Subject to any disclaimer, the term of this patent is extended or adjusted under 35 U.S.C. 154(b) by 0 days.

(21) Appl. No.: 16/202,339

(22) Filed: Nov. 28, 2018

(65) Prior Publication Data

US 2019/0161148 A1 May 30, 2019

(30) Foreign Application Priority Data

Nov. 28, 2017 (AU) ..... 2017268537

(51) Int. Cl.
*B63B 35/79* (2006.01)
*B63H 20/00* (2006.01)
*B63B 1/24* (2020.01)

(52) U.S. Cl.
CPC ..... *B63B 35/7943* (2013.01); *B63B 1/246* (2013.01); *B63B 35/7923* (2013.01); *B63H 20/007* (2013.01)

(58) Field of Classification Search
CPC ..... B63B 35/79; B63B 35/7943; B63B 1/24; B63B 1/248; B63B 35/7926; B63H 20/00; B63H 20/007; B63H 21/17; B63H 21/21; B63H 1/16; B63H 5/14; B63H 11/04; B63H 5/15
USPC ..... 440/6; 441/74
See application file for complete search history.

(56) References Cited

U.S. PATENT DOCUMENTS

| | | | | |
|---|---|---|---|---|
| 5,362,264 | A | 11/1994 | Parant | |
| 5,672,080 | A | 9/1997 | Gauthier | |
| 6,178,905 | B1 | 1/2001 | Dynes et al. | |
| 7,047,901 | B2 | 5/2006 | Chen | |
| 9,359,044 | B2 * | 6/2016 | Langelaan | B63B 35/7943 |
| 2003/0167991 | A1 | 9/2003 | Namanny | |
| 2008/0017174 | A1 * | 1/2008 | Kafer | B60T 8/3675 123/479 |
| 2008/0132127 | A1 | 6/2008 | Jansen | |
| 2011/0111650 | A1 | 5/2011 | Braden et al. | |
| 2011/0201238 | A1 | 8/2011 | Rott et al. | |
| 2016/0185430 | A1 | 6/2016 | Langelaan | |
| 2016/0325815 | A1 | 11/2016 | Nikmanesh | |
| 2016/0347428 | A1 | 12/2016 | Mahar | |
| 2018/0072383 | A1 * | 3/2018 | Montague | B63B 35/7943 |

FOREIGN PATENT DOCUMENTS

| | | | |
|---|---|---|---|
| DE | 102014005314 | A1 | 10/2015 |
| DE | 102016012068 | A1 | 4/2018 |

* cited by examiner

*Primary Examiner* — Lars A Olson
(74) *Attorney, Agent, or Firm* — Tarolli, Sundheim, Covell & Tummino LLP

(57) ABSTRACT

Disclosed is a module configured for removable attachment to a board and attached to an end of a mast, where the mast supports a hydrofoil and a motor to drive the board. The module includes a connector for connecting to a power source, internal control circuitry, and a thermal bridge to thermally connect the control circuitry to the mast. The module comprises a watertight cavity in which the internal control circuitry is contained.

16 Claims, 5 Drawing Sheets

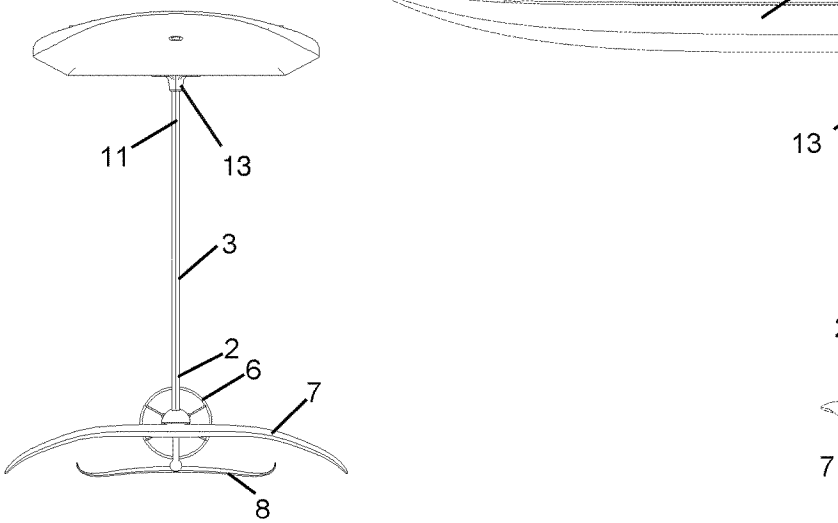
FIG. 1
FIG. 2
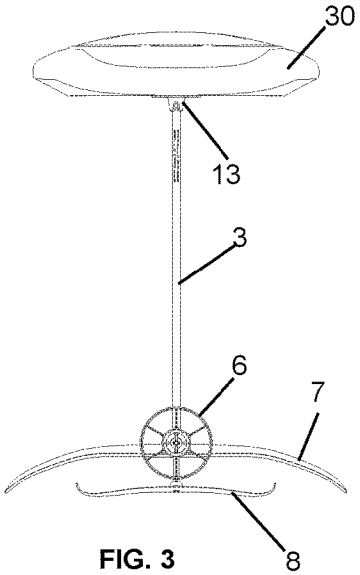
FIG. 3
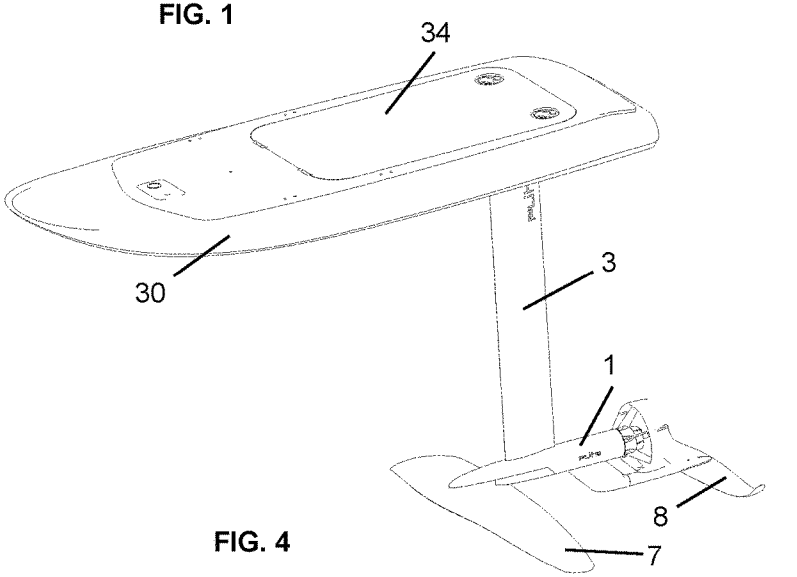
FIG. 4
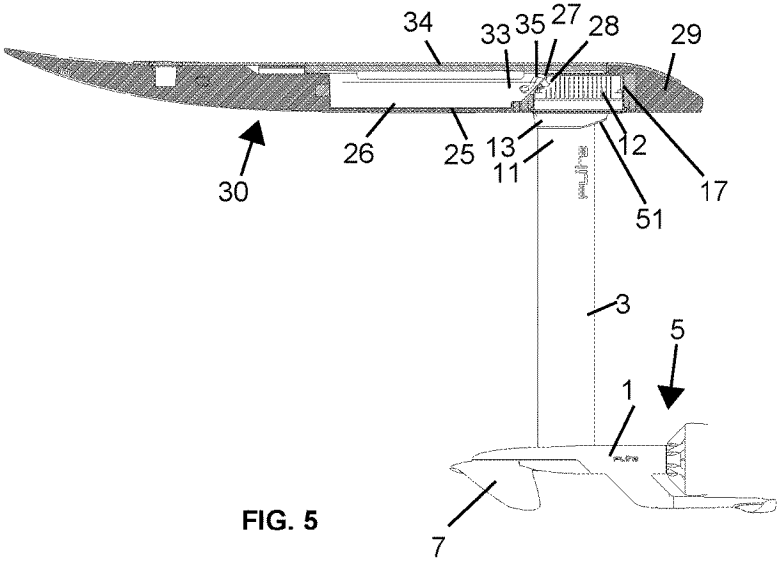
FIG. 5

MODULE FOR CONNECTING A MAST TO A BOARD

TECHNICAL FIELD

The present invention generally relates to a connection module that is attached to a mast and connects the mast to a board.

PRIOR APPLICATION

The present application claims priority from Australian Patent Number 2017268537, the contents of which is hereby included in its entirety.

BACKGROUND

A recent development in surfboard technology is the attachment of a motor to a hydrofoil surfboard. The hydrofoil motor is typically an electric motor mounted close to the hydrofoil. The hydrofoil elevates the board clear of the water when under power from the motor, which reduces drag and provides high speed travel over the water.

The hydrofoil motor is positioned at a lower end of a mast while an upper end of the mast is bolted to an underside of the board. A housing is fixed into a top side of the board to accommodate batteries. External wires connect to the batteries and circuitry within the housing. The wires pass through a hole in the board and internally down the mast in order to connect to the electric motor.

The reference in this specification to any prior publication (or information derived from it), or to any matter which is known, is not, and should not be taken as, an acknowledgement or admission or any form of suggestion that prior publication (or information derived from it) or known matter forms part of the common general knowledge in the field of endeavour to which this specification relates.

SUMMARY

According to one aspect of the invention, there is provided a module configured for removable attachment to a board and attached to an end of a mast, the mast supporting a hydrofoil and a motor to drive the board, the module including: a connector for connecting to a power source; internal control circuitry; and a thermal bridge to thermally connect the control circuitry to the mast.

In one example form, the thermal bridge also thermally connects the internal control circuitry to a plurality of external cooling fins. In another form, the module further includes an attachment plate that secures the mast to the module, wherein the attachment plate forms at least part of the thermal bridge. In yet another form, the cooling fins extend from the attachment plate such that they are located adjacent the mast on an underside of the board when the module is attached to the board.

Preferably, the module includes a watertight cavity in which the internal control circuitry is contained. In other particular, but non-limiting, example forms: the mast is made substantially from aluminium or an aluminium alloy; the module further includes a connector for data communication; and the internal control circuitry includes electronic speed control for the electric motor.

In still further particular, but non-limiting, example forms: the module further includes fittings to releasably fix the module to the board; and the fittings include lateral flanges with apertures to receive fasteners that fix the module to the board.

According to another aspect of the invention, there is provided a mast, including: a motor and a hydrofoil coupled to a lower end; and a module fitted to an upper end; wherein the module is substantially as defined herein.

According to yet another aspect of the invention, there is provided a board with a mounting section including a frame that defines a through hole from an underside of the board to a connection bay, wherein the mounting section is configured to receive a module that is substantially as defined herein, the module being fixed relative to the frame so that the module projects into the bay for the connector to be connected to a power source.

In one example form, the frame is an insert fixed into the board, the insert having attachment holes configured to match fittings on the module. In another form, the board further includes a compartment for a power source and a below deck space between the compartment and the bay for connection between the power source and the connector of the module. In yet another form, the board further includes a tray embedded in a body of the board, the tray being an integral unit which defines the bay, the compartment and the below deck space.

It will be appreciated that the broad forms of the invention and their respective features can be used in conjunction, interchangeably and/or independently, and reference to separate broad forms is not intended to be limiting.

BRIEF DESCRIPTION OF FIGURES

Example embodiments should become apparent from the following description, which is given by way of example only, of at least one preferred but non-limiting embodiment, described in connection with the accompanying figures, wherein:

FIG. 1 illustrates a front view of an electric hydrofoil surfboard that has a board connected to a mast with a hydrofoil motor;

FIG. 2 illustrates a side view of the hydrofoil surfboard from FIG. 1;

FIG. 3 illustrates a rear view of the hydrofoil surfboard from FIG. 1;

FIG. 4 illustrates an isometric view of the hydrofoil surfboard from FIG. 1;

FIG. 5 illustrates a cross sectional side view of the hydrofoil surfboard from FIG. 1;

DETAILED DESCRIPTION

Figure 8:
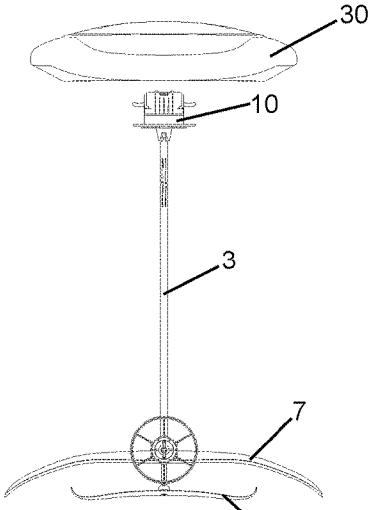
FIG. 8 illustrates a rear view of the hydrofoil surfboard from FIG. 6.
Figure 7:
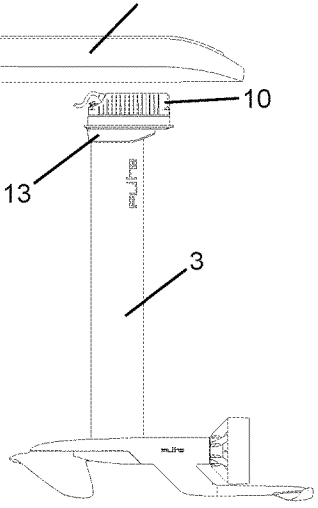
FIG. 7 illustrates a side view of the hydrofoil surfboard from FIG. 6.
Figure 6:
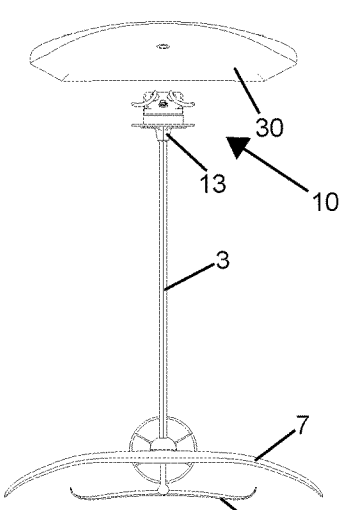
FIG. 6 illustrates a front view of the hydrofoil surfboard from FIG. 1, where a module at the top end of the mast has been disconnected from the board.
Figure 10:
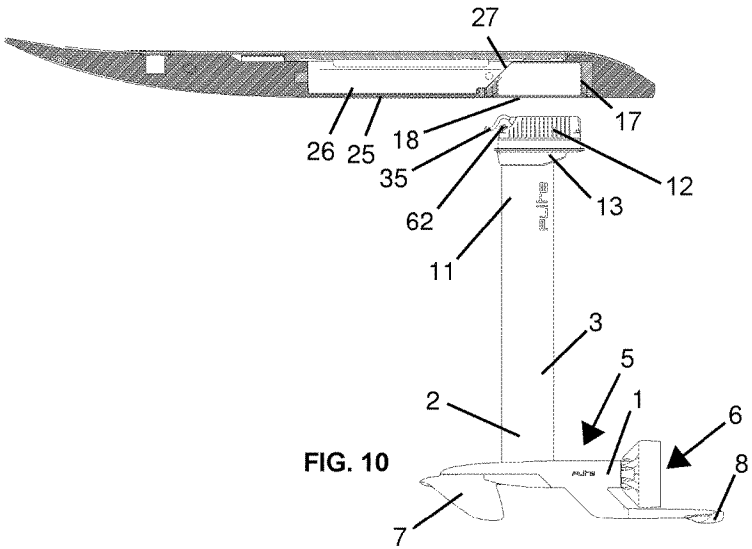
FIG. 10 illustrates a cross sectional side view of the hydrofoil surfboard from FIG. 6.
Figure 9:
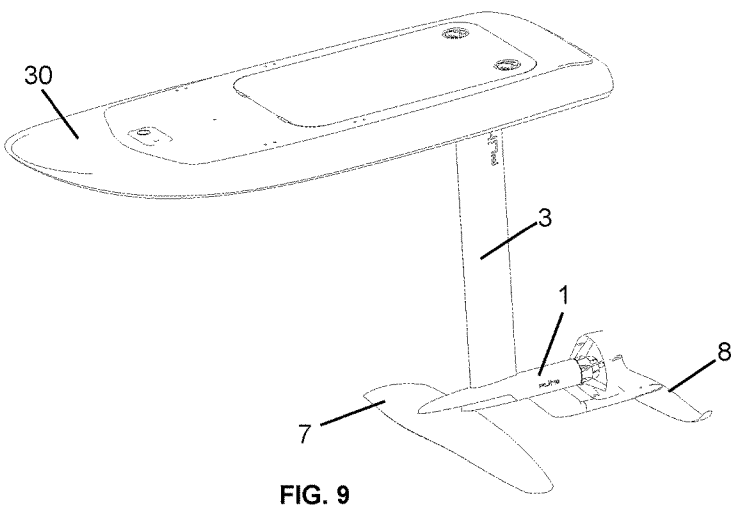
FIG. 9 illustrates an isometric view of the hydrofoil surfboard from FIG. 6.
Figure 11:
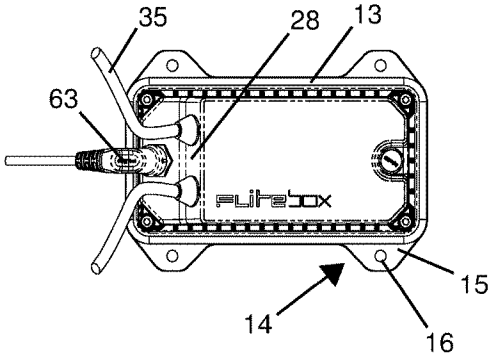
FIG. 11 illustrates a top view of the module from FIG. 6.
Figure 12:
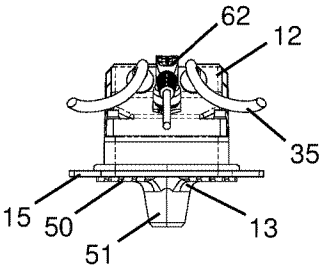
FIG. 12 illustrates a front view of the module from FIG. 11.
Figure 14:
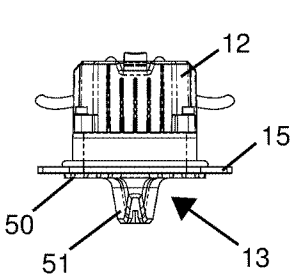
FIG. 14 illustrates a rear view of the module from FIG. 11.
Figure 15:
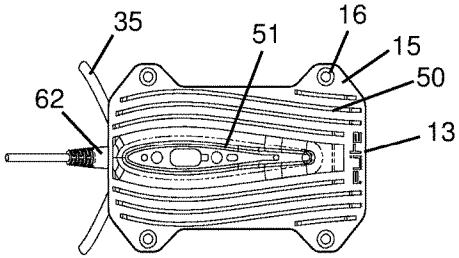
FIG. 15 illustrates a bottom view of the module from FIG. 11.
Figure 13:
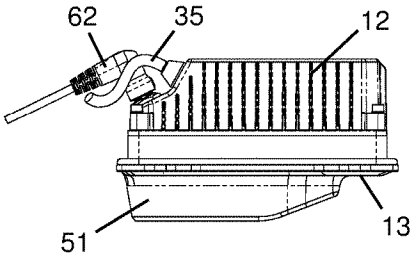
FIG. 13 illustrates a side view of the module from FIG. 11.

The following modes, given by way of example only, are described in order to provide a more precise understanding of the subject matter of a preferred embodiment or embodiments.

In the Figures, incorporated to illustrate features of an example embodiment, like reference numerals are used to identify like parts throughout the Figures.

Figure 18:
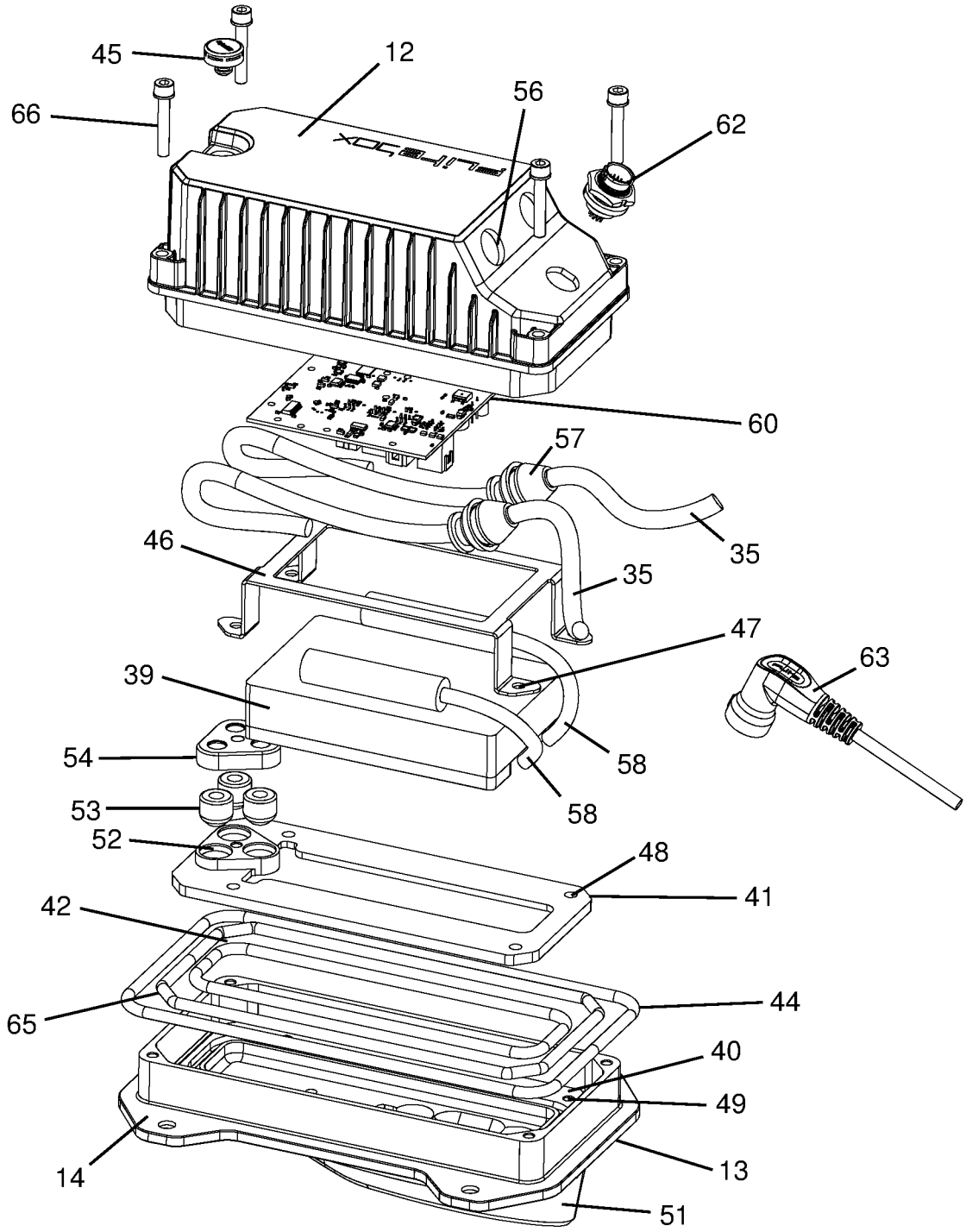
FIG. 18 illustrates an exploded view of the module from FIG. 11.

An embodiment of a module 10 according to the invention is shown in FIG. 18. The module 10 is configured for removable attachment to a board. While not shown in this figure, the module 10 is attached to an end of a mast, the mast supporting a hydrofoil and a motor to drive the board. The module includes a connector, in this case leads 35, for connecting to a power source. Internal control circuitry is provided in the module 10, such as Electronic Speed Control (ESC) block 39.

A thermal bridge thermally connects the ESC block 39 to the mast. In the embodiment shown, the thermal bridge includes a plate 41 and a base 40, but it will be appreciated that the thermal bridge may take many other forms in alternative embodiments. For example, the plate 41 may be omitted in some alternative embodiments, thereby further reducing the thermal resistance between the internal control circuitry and the mast.

The module 10 is advantageous because it allows the mast and associated components to be quickly and easily removed and reattached to the board. Removal of the mast from the board is typically necessary for transporting the board, so it is desirable for the mast to be easily reattached. This is particularly important for this type of product, as this task must be performed away from a workshop, such as on a beach or other outdoor space.

The module 10 greatly simplifies this attachment of the mast to the board, as the connection of the leads to the power source is relatively simple. Importantly, no liquid connections for cooling to the internal circuitry or any other components are necessary, thanks to the thermal bridge connecting the circuitry to the mast.

A number of other example features will now be described, which are included in the embodiment shown in the Figures, but may not be provided in some alternative embodiments or may be provided in a different form in various other alternative embodiments.

Referring to FIGS. 1 to 5, a hydrofoil motor 1 is shown at a lower end 2 of a mast 3. The hydrofoil motor 1 includes an electric motor 5 with a propeller 6 and integral front hydrofoil 7 and rear hydrofoil 8. A board 30 is attached at an opposite end of the mast 3 to the motor 1. These Figures all show the system in an assembled configuration ready for use.

Referring now to FIGS. 6 to 10, the motor 1 and mast 3 are shown separated from the board 30. A module 10 is attached to an upper end 11 of the mast 3. The module 10 includes a housing 12 and an attachment plate 13. Removing the module 10 from the board 30 in this manner is convenient for transporting the board, for example, as described previously.

Figure 16:
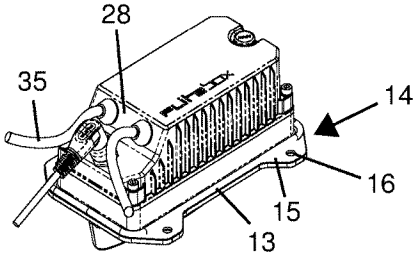
FIG. 16 illustrates a front isometric view of the module from FIG. 11.

FIGS. 11 to 18 show the module 10 in more detail. As shown in FIG. 16, for example, the attachment plate 13 has fittings 14 in the form of lateral flanges 15 with apertures 16. These fittings 14 are used for securing the module 10 to the board 30, as will be described in more detail below. The module 10 is shown in these Figures without the mast 3 for clarity, however typically the module 10 is not designed to be easily removed from the mast 3.

Figure 19:
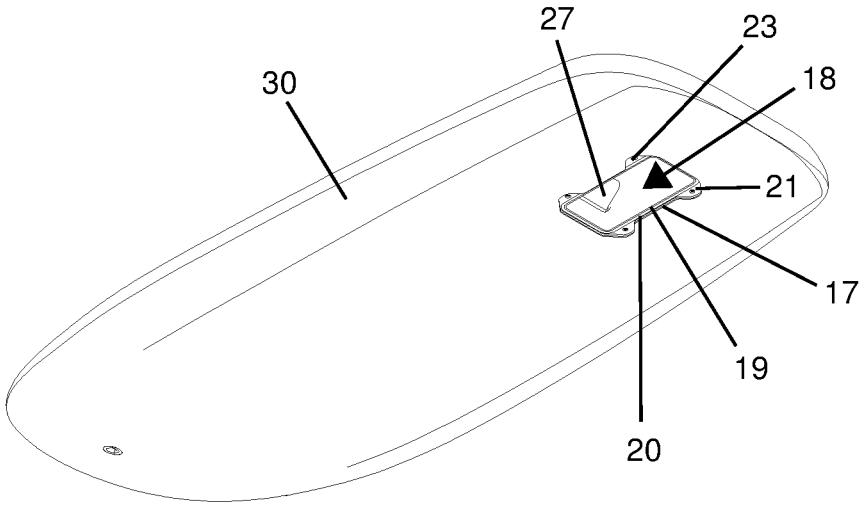
FIG. 19 illustrates a bottom isometric view of a board with the module removed.
Figure 20:
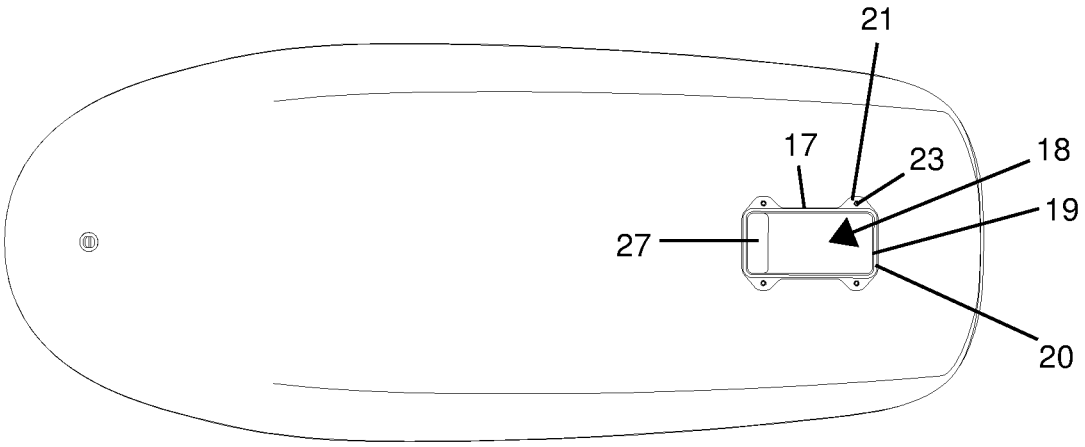
FIG. 20 illustrates a bottom view of the board from FIG. 19.

FIGS. 19 and 20 show an underside of a board 30. A frame 17 with an opening 18 is embedded in the board 30. The opening 18 is bordered by a lip 19 adjacent a channel 20 that extends around a periphery of the hole 18.

Rebates 21 are formed in a face of the frame 17. The rebates 21 are configured to match the flanges 15 of the module 10. Attachment holes 23 are positioned align with the holes 16 of the module 10 when it is fitted. In this way, the attachment holes 23 receive fasteners that, in use, fix the module 10 to the frame 17. These fasteners are preferably bolts or screws that screw fix the module 10 to the board 30, however it will be appreciated that many other forms of fasteners may be used in alternative embodiments.

To connect the mast 3 and module 10 to the board 30, the housing 12 is inserted through the opening 18 on the underside of the board 30 until the flanges 15 are seated in the rebates 21. Fasteners can then be used to secure the module 10 in place.

With reference to FIG. 5, the mast 3 and module 10 are shown connected into the frame 17. A tray 25 is embedded in a body 29 of the board 30, forming a compartment 26 and a connection bay 27. An end 28 of the module 10 projects into the board 30 so that it is close to the connection bay 27 when the mast 3 is assembled into the tray 25.

A power source in the form of a battery can be housed in the compartment 26. A space 33 is provided between the connection bay 27 and the portion of the compartment 26 where the power source is housed. A deck 34 of the board 30 is removable to allow access to the compartment 26, connection bay 27 and power source. The space 33, together with the connection bay 27, allows external leads 35 of the module 10 to connect with the power source.

In an alternative arrangement, the tray 25 may be dispensed with and the compartment 26 and bay 27 can instead be formed or moulded directly into the body 29 of the board 30. In yet another alternative embodiment, the frame 17 may also be integrally formed with the compartment 26 and/or body 29 of the board 30.

Referring to FIG. 18, the construction of the module 10 is shown in more detail. An Electronic Speed Control (ESC) block 39 with control circuitry is housed within the module 10. When the module 10 is assembled, the ESC block 39 is connected to a base 40 of the attachment plate 13. In some alternative embodiments this mounting may be direct, however in the present embodiment the ESC block 39 is mounted to a plate 41, with the plate then being mounted to the base 40. A seal 42 is positioned between the base 40 and the plate 41.

The ESC block 39 is held securely to the plate 41 by a bracket 46. Fasteners can extend through the holes 47 in the bracket, holes 48 in the plate 41 and into holes 49 in the base 40. A thermal paste or thermal adhesive may be used to maximise the thermal conductivity between the ESC block 39, plate 41 and base 40.

The ESC block 39 typically generates a large amount of heat during use, and one of the main challenges in designing a system such as this involves providing sufficient cooling to this component. The direct connection between the ESC block 39 and the base 40 acts as a thermal bridge between the control circuitry of the ESC block 39 and the mast 3, thereby dissipating the heat generated into the mast 3.

The thermal bridge connecting the control circuitry of the ESC block 39 to the mast 3 removes the need for active cooling, such as a liquid coolant circuit or similar, as is typically seen in the prior art. This is advantageous for a number of reasons, including reducing complexity and also reducing the risk of leaks that would cause damage to sensitive components. Importantly, removing the need for a liquid cooling circuit also removes the need for connecting and disconnecting liquid supply lines when the mast is separated from the board, greatly simplifying this assembly process.

In the embodiment currently being described, the internal control circuitry includes electronic speed control for the electric motor. Containing this circuitry in the module 10, rather than closer to the motor 5 for example, is advantageous because it allows the underwater components to be reduced in size as much as possible. This in turn reduces drag and improves the performance of the board.

Placing this circuitry closer to the motor may otherwise be desirable for assisting with cooling, however the present invention removes this need. Of course, it will be appreciated that in some alternative embodiments of the invention the motor speed control may be placed outside of the module, with the module containing other control circuitry components.

Referring still to FIG. 18, the plate 41 includes a number of tapered openings 52, into which cable gland inserts 53 are fitted and held in place by a cable gland plate 54. The cable gland plate 54 is held in place by a fastener which can be tightened to compress the inserts 53. This sealing system allows cables to pass from the ESC block 39 into the base of the attachment plate 13 and into the mast 3, but prevents any water that may leak in from the base of the attachment plate 13 from reaching the ESC block 39 or other internal parts of the module 10.

This sealing system is advantageous over other systems as it accommodates the significant thermal stress and expansion due to thermal loads without compromising the seal. It will still be appreciated, however, that alternative sealing methods may also be used in some alternative embodiments.

The leads 35 from the battery enter the module 10 through holes 56 near the top of the housing 12 and are sealed by cable glands 57. Power is provided to the ESC block 39 through lower leads 58.

A motor control printed circuit board (PCB) 60 is positioned above the ESC block 39 and can be configured and/or programmed to provide more sophisticated control functions based on a range of operational conditions and/or inputs from various internal and/or external sensors. A socket 62 is also provided that allows simple connection via a quick disconnect 63 to enable data transfer between the motor control PCB 60 and external devices or components, such as a receiver and/or other sensors.

A seal 65 is positioned between the base 40 and the housing 12 which are fastened together at corners by screws 66 or other suitable fasteners. The connection of the housing 12 to the attachment plate 13 in this way encloses the other components to form the complete module as shown in FIGS. 11 to 17.

It will be appreciated that the control circuitry is located in a watertight cavity once the module 10 is assembled. This is achieved by various components, including the various seals as discussed previously. Advantageously, however, the present invention through the thermal bridge effectively allows heat transfer from inside this watertight cavity to the outside, without the need for any physical transfer of material, such as a liquid cooling circuit. This thereby helps to maintain the watertight cavity intact over time as components wear, due to the reduced complexity of this setup.

Otherwise stated, the module 10 includes a watertight cavity in which the internal control circuitry is contained. That is, the attachment plate 13, plate 41 and housing 12 together create a cavity that contains the ESC block 39, motor control PCB 60 and various other components that may be sensitive to moisture.

During use, even with the thermal bridge connecting the ESC block 39 to the mast 3, the temperature inside the module 10 can increase significantly. This temperature can also reduce quite rapidly when use is stopped, particularly if the mast 3 and attachment plate 13 remain in contact with cool water. To help maintain this watertight cavity despite the thermal cycling, a vent 45 is provided in the housing 12.

Figure 17:
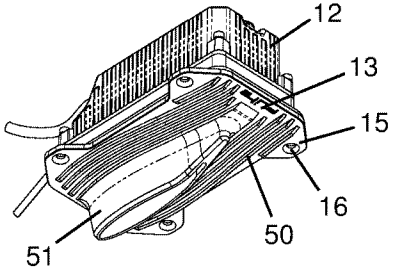
FIG. 17 illustrates a rear isometric view of the module from FIG. 11.

Referring to FIG. 17, the attachment plate 13 includes external cooling fins 50. The thermal bridge thermally connects the internal control circuitry of the ESC block 39 to these fins 50. That is, the fins 50 extend from the base 40 of the attachment plate 13, which in turn is connected to the plate 41 that connects to the base of the ESC block 39.

The fins 50 in the embodiment shown are located adjacent a mast connection flange 51. The flange 51 ensures a strong connection between the mast 3 and the attachment plate 13 and also assists in maximising heat transfer between the base 40 of the attachment plate 13 and the mast 3.

The fins 50 on the attachment plate 13 are located on the underside of the board 30 when the module 10 is fitted to the board 30. These fins 50, being part of the attachment plate 13, are connected by the thermal bridge to the ESC module 39.

The fins 50 can thereby provide additional cooling for the control circuitry of the ESC module 39, as they may transfer heat to the air when the board is above the surface of the water or they may transfer heat to the water when the board is on the surface or if water is splashed onto the fins 50.

It should be appreciated, however, that the fins are an optional feature that may not be included in some alternative embodiments of the invention, or may be provided in different locations in yet other embodiments.

The module 10 and mast 3 thereby form an integral unit that is effectively plugged into the board 30 and fixed in place. A gasket 44 on the outside of the attachment plate 13 helps to seal the module 10 with the board 30 when fitted, in conjunction with the channel 20.

In an alternative embodiment of the invention, instead of attaching directly to the frame 17, the module 10 and mast 3 can instead be fixed directly to an underside 45 of the board 30 using appropriate bolts or the like.

In any case, the module 10 accommodates control circuitry that can be used to either modulate motor speed and/or, in various alternative embodiments of the invention, perform other functions such as controlling the hydrofoils 7, 8 to adjust the aspect of the board 30.

The control circuitry generates heat which can be readily dissipated into the water via the mast 3, which is preferably formed of a high heat transmissive material such as aluminium or an aluminium alloy.

Since the control circuitry is contained within the module 10 fitted directly to the upper end 11 of the mast 3, the only wired connection outside of the module 10 is to the power source via the external leads and a single data connection. As such, there is no requirement for the many wires and liquid connections of the prior art boards.

While the connector provided for the module 10 to connect to the power source in the preferred embodiment takes the form of two leads 35, it will be appreciated that many other forms of connector may be provided in alternative forms of the invention. For example, the connector may be a single lead, a socket or multiple sockets. Similarly, the socket 62 may also be provided in many other forms. In still yet other forms of the invention, the data and power connections may be combined or arranged in a different configuration of leads, sockets or other forms of connector.

The thermal bridge described in this specification relates to thermal conduction by solid components that are in physical contact. It will be appreciated, however, that a thermal bridge can be any form of connection that provides low thermal resistivity, and many other configurations of thermal bridge will be possible and are considered to fall within the scope of the present invention.

The invention has been described with reference to a board specifically in the context of a surfboard with a mast mounted motor. However, reference to 'board' should be taken as a reference to any form of water craft.

As may be appreciated, many modifications and variations may be made without departing from the spirit and scope of the invention described. For example, the module can be connected to a mast with a motor other than a hydrofoil motor and the motor itself need not be an electric motor driving a propeller but could instead be a jet nozzle, turbine or the like.

In the foregoing description of preferred embodiments, specific terminology has been resorted to for the sake of clarity. However, the invention is not intended to be limited to the specific terms so selected, and it is to be understood that each specific term includes all technical equivalents which operate in a similar manner to accomplish a similar technical purpose. Terms such as "front" and "rear", "inner" and "outer", "above" and "below" and the like are used as words of convenience to provide reference points and are not to be construed as limiting terms.

Whilst the present invention has been described with reference to particular embodiments, it will be understood that many modifications will be apparent to those skilled in the art. All such variations and modifications should be considered to fall within the scope of the invention as broadly described and as claimed below.

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

LIST OF PARTS

| | |
|---|---|
| 1 | Hydrofoil motor |
| 2 | Mast lower end |
| 3 | Mast |
| 5 | Electric motor |
| 6 | Propeller |
| 7 | Front hydrofoil |
| 8 | Rear hydrofoil |
| 10 | Module |
| 11 | Mast upper end |
| 12 | Housing |
| 13 | Attachment plate |

-continued

| | |
|---|---|
| 14 | Fitting |
| 15 | Flange |
| 16 | Aperture |
| 17 | Frame |
| 18 | Opening |
| 19 | Lip |
| 20 | Channel |
| 21 | Rebate |
| 23 | Attachment hole |
| 25 | Tray |
| 26 | Compartment |
| 27 | Connection Bay |
| 28 | End/top of module housing |
| 29 | Board body |
| 30 | Board |
| 34 | Board deck |
| 35 | Lead |
| 36 | Opening |
| 39 | ESC block |
| 40 | Base of attachment plate |
| 41 | Plate |
| 42 | Seal |
| 44 | Seal |
| 45 | Vent |
| 46 | Bracket |
| 47 | Hole |
| 48 | Hole |
| 49 | Hole |
| 50 | External cooling fins |
| 51 | Mast connection flange |
| 52 | Opening |
| 53 | Cable gland insert |
| 54 | Cable gland plate |
| 56 | Holes in the housing |
| 57 | Cable glands |
| 58 | Lower leads |
| 60 | Motor control PCB |
| 62 | Socket |
| 63 | Quick disconnect |
| 65 | Seal |
| 66 | Fastener |

The invention claimed is:

1. A module configured for removable attachment to a board and attached to an end of a mast, the mast supporting a hydrofoil and a motor to drive the board, the module comprising:

a housing comprising internal control circuitry;

a connector for connecting the internal control circuitry to a power source located in the board; and a thermal bridge to thermally connect the control circuitry to the mast and to transfer heat generated by the internal control circuitry to the mast for dissipation thereof.

2. The module according to claim 1, wherein the thermal bridge also thermally connects the internal control circuitry to a plurality of external cooling fins.

3. The module according to claim 1, further comprising an attachment plate that secures the mast to the module, wherein the attachment plate forms at least part of the thermal bridge.

4. The module according to claim 3, wherein the thermal bridge also thermally connects the internal control circuitry to a plurality of external cooling fins.

5. The module according to claim 4, wherein the cooling fins extend from the attachment plate such that they are located adjacent the mast on an underside of the board when the module is attached to the board.

6. The module according to claim 1, wherein the module comprises a watertight cavity in which the internal control circuitry is contained.

7. The module according to claim 1, wherein the mast is made substantially from aluminium or an aluminium alloy.

8. The module according to claim 1, wherein the module further comprises a connector for data communication.

9. The module according to claim 1, wherein the internal control circuitry includes electronic speed control for the electric motor.

10. The module according to claim 1, further comprising fittings to releasably fix the module to the board.

11. The module according to 10, wherein the fittings include lateral flanges with apertures to receive fasteners that fix the module to the board.

12. A mast, comprising:

a motor and a hydrofoil coupled to a lower end; and a module fitted to an upper end;

wherein the module is defined according claim 1.

13. A board with a mounting section comprising a frame that defines a through hole from an underside of the board to a connection bay, wherein the mounting section is configured to receive a module that is defined according to claim 1, the module being fixed relative to the frame so that the module projects into the bay for the connector to be connected to a power source.

14. The board according to claim 13, wherein the frame is an insert fixed into the board, the insert having attachment holes configured to match fittings on the module.

15. The board according to claim 13, further comprising a compartment for a power source and a below deck space between the compartment and the bay for connection between the power source and the connector of the module.

16. The board according to claim 15, further comprising a tray embedded in a body of the board, the tray being an integral unit which defines the bay, the compartment and the below deck space.

* * * * *